US009617700B2

(12) United States Patent
Eckman

(10) Patent No.: US 9,617,700 B2
(45) Date of Patent: Apr. 11, 2017

(54) LARGE AREA LIQUID SOLUTION APPLICATION

(71) Applicant: Ron Eckman, Pompano Beach, FL (US)

(72) Inventor: Ron Eckman, Pompano Beach, FL (US)

( * ) Notice: Subject to any disclaimer, the term of this patent is extended or adjusted under 35 U.S.C. 154(b) by 135 days.

(21) Appl. No.: 14/210,027

(22) Filed: Mar. 13, 2014

(65) Prior Publication Data

US 2014/0263690 A1 Sep. 18, 2014

Related U.S. Application Data

(60) Provisional application No. 61/780,965, filed on Mar. 13, 2013.

(51) Int. Cl.
*E01H 10/00* (2006.01)
*B05B 13/00* (2006.01)

(52) U.S. Cl.
CPC ..... *E01H 10/007* (2013.01); *B05B 13/005* (2013.01)

(58) Field of Classification Search
CPC B05B 1/20; B05B 1/202; B05B 1/205; B05B 9/01; B05B 9/007; B05B 9/06; B05B 9/043; B05B 9/0413; B05B 9/0416; B05B 13/005; E01H 10/007; E01C 19/17; E01C 19/174; E01C 19/176; E01C 19/21
USPC ..... 239/159, 172, 176, 526, 566, 581.1
See application file for complete search history.

(56) References Cited

U.S. PATENT DOCUMENTS

| | | | | |
|---|---|---|---|---|
| 2,995,307 A | | 8/1961 | McMahon | |
| 3,921,907 A | | 11/1975 | Anderson | |
| 4,315,602 A | | 2/1982 | Kubacak et al. | |
| 4,593,855 A | | 6/1986 | Forsyth | |
| 4,673,130 A | * | 6/1987 | Simpson | A01M 7/0075 239/167 |
| 4,796,808 A | | 1/1989 | Linda et al. | |
| 4,817,870 A | | 4/1989 | Dalton | |
| 5,381,962 A | * | 1/1995 | Teague | B05B 12/00 239/525 |
| 5,538,185 A | | 7/1996 | Rabitsch et al. | |
| 6,010,079 A | | 1/2000 | Mayfield, Jr. et al. | |
| 6,138,770 A | * | 10/2000 | Kayser | A01B 59/06 172/272 |
| 6,382,523 B1 | | 5/2002 | Hedegard | |

(Continued)

*Primary Examiner* — Arthur O Hall
*Assistant Examiner* — Cody Lieuwen
(74) *Attorney, Agent, or Firm* — Gary L. Eastman; Eastman & McCartney LLP

(57) ABSTRACT

A Large Area Liquid Solution Application includes a boom equipped with a series of easily removable spray nozzles, for easier cleaning and maintenance, attached to a standard truck trailer hitch receiver with a pump assembly attached onto a reservoir loaded onto a truck bed. This invention presents an effective deicing apparatus and method to spray brine evenly on the pavement. The reservoir is easily secured manually with standard ratchet straps and the boom connects to any standard truck tow hitch without the use of tools. The equipment panel with attached pump is easily removable and the pump fittings and corresponding output hoses manually snap in and out of place to allow easier maintenance and cleaning. Communicating wirelessly, the present invention is activated by a wireless key enabling a truck driver to control the system without needing to exit the vehicle and manually shut of the sprayer.

19 Claims, 6 Drawing Sheets

(56) References Cited

U.S. PATENT DOCUMENTS

| | | | | |
|---|---|---|---|---|
| 6,454,183 | B1 | 9/2002 | Hedegaard | |
| 7,043,890 | B2 * | 5/2006 | Lofton | A01D 43/14<br>56/16.8 |
| 7,413,132 | B1 | 8/2008 | Bogart et al. | |
| 2006/0266853 | A1 * | 11/2006 | Gamble, II | A01C 15/006<br>239/661 |
| 2008/0087745 | A1 * | 4/2008 | Pearson | B05B 1/046<br>239/428.5 |
| 2011/0315797 | A1 * | 12/2011 | Warchola | E01C 19/21<br>239/657 |

* cited by examiner

LARGE AREA LIQUID SOLUTION APPLICATION

RELATED APPLICATION

This application claims the benefit of priority to U.S. Provisional Application No. 60/780,965, filed on Mar. 13, 2013, entitled "Large Area Liquid Solution Application."

FIELD OF THE INVENTION

The present invention pertains generally to portable spraying apparatus for distributing liquids, and more particularly to deicing systems which are attached to a reservoir loaded on a truck to deice the pavement while the truck is moving.

BACKGROUND OF THE INVENTION

In today's modern society, maintaining road infrastructure is imperative in promoting commerce and safe transportation. Traffic accidents are a leading cause of death in America today. Many such collisions are due to unsafe road conditions stemming from severe weather conditions including ice and snow. While state governments are fairly proactive with maintaining the roads with large snow plowing trucks and industrial sized deicing vehicles, many smaller locally accessed roads also suffer from unsafe road conditions from severe weather. In places where local municipal governments have no programs for winter road deicing maintenance, small business owners and residents are left to deice their busy roads and intersections. Often times, such work is contracted at great expense to the individual. With the high level of financial strain experienced by most small business owners and individuals, it would be advantageous to provide consumers with a low cost, easily maintained deicing system.

A common method to lower the inherent risk of traffic accidents on roadways is to spread brine to increase the friction on the roads. Liquid brine has been shown to allow less brine usage while still attaining the desired added traction. Among those products which use liquid brine, U.S. Pat. No. 6,382,523 discloses a road brine spreader for driving along a road and spreading out liquid brine under pressure via a number of liquid nozzles.

A problem arising from the application of liquid brine is the crystallization which occurs at the end of the nozzle tips due to the severe cold weather conditions. Crystallization occurs over time and results in clogged nozzle heads and an uneven spray distribution. Because the nozzles are permanently attached to the boom, removing crystallization in the nozzle tip is burdensome and time consuming. The continual need to maintain the nozzle heads adds burden and expense to roadway deicing.

Large industrial size deicing systems are not practical for use by small business owners. In an effort to provide access to deicing systems for small business and individual use, many products have been made available for consumers. For instance, U.S. Pat. No. 7,413,132 discloses a sprayer which can be towed behind a tractor or lawn mower.

The sprayer assembly includes a frame that supports a tank for storing a liquid chemical. A pump moves the liquid chemical from the tank to one or more spray nozzles through a flexible hose supported by a boom. This sprayer includes wheels to engage and move over the underlying ground surface. The sprayer assembly further discloses flexible hoses with spray nozzles which deliver the liquid chemical to the desired area. However, this sprayer assembly utilizes an external housing and an independent chassis with wheels. The internal infrastructure of the pump systems, liquid storage tanks, and power source are fully encompassed within the external housing and not easily accessible by the consumer without complete disassembly. In order to replace internal parts and diagnose maintenance issues, the entire housing must be disassembled. Less technically savvy individuals will need to take their sprayer to the manufacturer for adjustments. Further troublesome, the wheel and chassis of this sprayer provides only limited ground clearance, and is susceptible to road hazards interfering with smooth, trouble-free operation.

In light of the above, it would be advantageous to provide a sprayer assembly with separate exposed subsystems which are individually accessible. It would be further advantageous to be able to disassemble the sprayer for easy storage in the off season without requiring difficult disassembly and reassembly or the need for professional assistance. It would be further advantageous to have easily removable nozzle tips, facilitating user-friendly cleaning and reduced maintenance time.

SUMMARY OF THE INVENTION

A Large Area Liquid Solution Application of the present invention is an affordable residential and light commercial sprayer system that is simple to maintain and to use. By attaching a boom equipped with a series of sprayers to a standard truck trailer hitch receiver, and attaching an equipment panel on a reservoir loaded on a truck bed, this invention presents an effective deicing method of spraying brine evenly on the pavement.

One aspect of the present invention is the ability to provide a liquid solution application system easily fitted to any standard pickup truck. No tools are required to install the Large Area Liquid Solution Application of the present invention; rather, it can be secured manually with standard ratchet straps. Additionally, the equipment panel, including the pump and pressure gauge, is removable from the rest of the system.

The boom assembly of the Large Area Liquid Solution Application of the present invention connects to any standard trailer hitch receiver. The boom assembly utilizes detachable snap-on nozzles that are easily removed for cleaning and maintenance. The pump fittings and output houses manually snap in and out of place. Various size hoses may also be implemented for alternate uses. Communicating wirelessly, the present invention is activated by a wireless key, enabling a truck driver to control the system without needing to exit the vehicle and manually shut of the sprayer.

It is further contemplated that the preferred embodiment can provide for the application of water for gardening purposes and dust control in construction sites. Other types of liquid applications have been fully contemplated herein and can be used without departing from the scope of the present invention.

An alternative embodiment of the present invention provide for the application of liquid solution through a handheld sprayer in place of the boom assembly equipped with the series of detachable spray nozzles and attached to the standard truck trailer hitch receiver. Switching between the boom assembly equipped with the series of detachable sprayer nozzles and the handheld sprayer is accomplished quickly and easily by switching the output connector of the equipment assembly to the desired output apparatus, either the boom assembly or the handheld sprayer.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
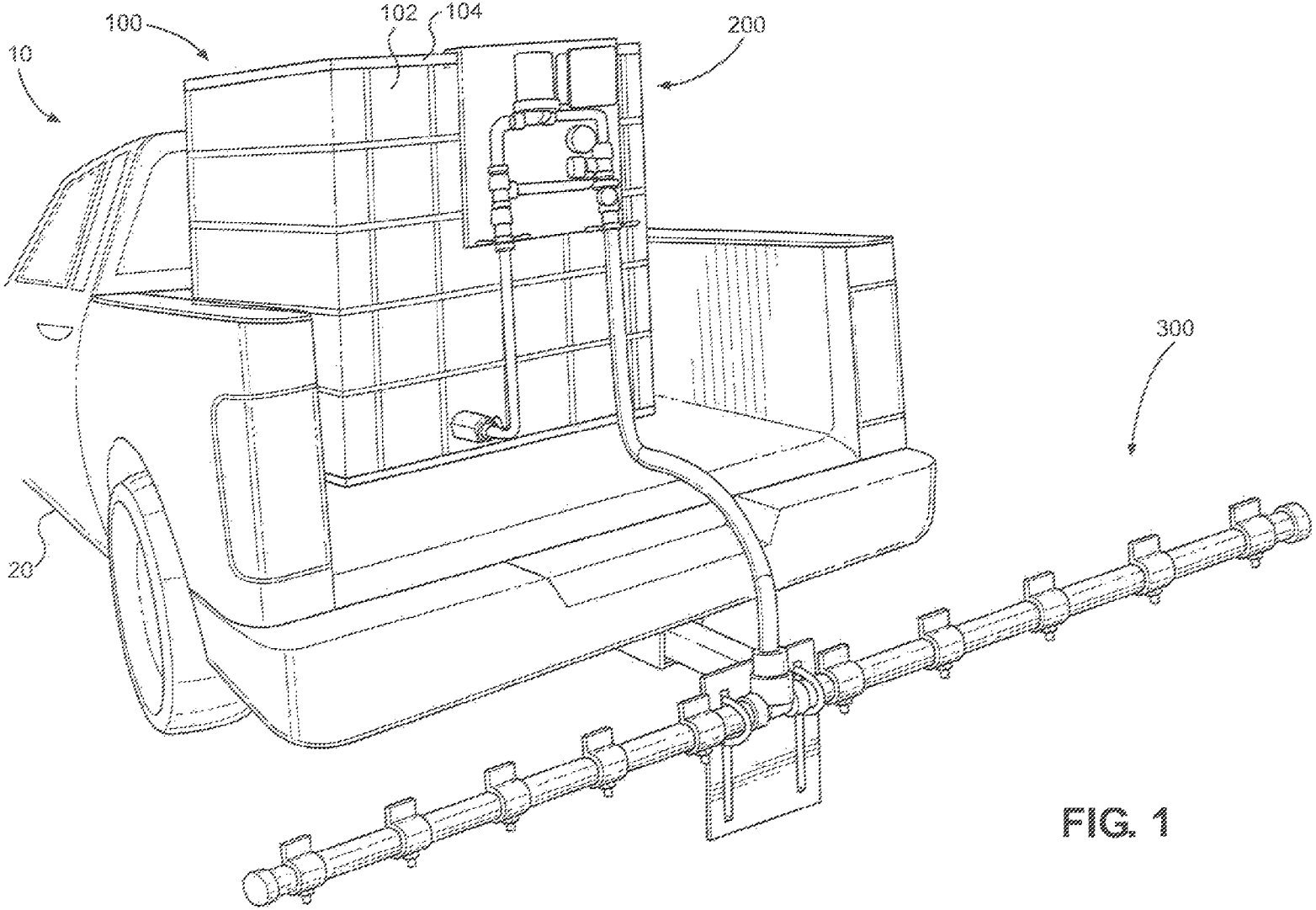
FIG. 1 is a front perspective view of the present invention having a boom assembly connected to an equipment panel attached to a reservoir loaded onto a pick-up truck.

Referring initially to FIG. 1, a preferred embodiment of the Large Area Liquid Solution Application of the present invention is shown and generally labeled 10. A reservoir 100 includes a lightweight metal frame 104 that encompasses a fortified plastic tank 102. The tank 102 is filled with liquid brine for output onto roadway surfaces. The reservoir 100 is loaded on to any standard size pickup truck 20. A standard forklift lifts the reservoir 100 on and off the pickup truck 20. Using a multiple number of ratchet straps (not shown) or other standard attachment means, the reservoir 100 is easily secured onto the pickup truck 20.

In the preferred embodiment of the Large Area Liquid Solution Application 10 of the present invention, tank 102 can hold approximately 250-270 gallons of brine, where 1 gallon of brine can cover 1000 $ft^2$ of pavement for a total coverage area of 250,000-270,000 $ft^2$. While this construction and loading method of the reservoir is particularly well suited for the Large Area Liquid Solution Application 10 of the present invention, other construction materials and methods of attaching the reservoir 100 to a pickup truck 20 may be used without departing form the spirit and scope of the present invention.

An equipment panel 200 is removably attached to the reservoir 100 and a boom assembly 300 is connected to a trailer hitch receiver 22 of the pickup truck 20. The equipment panel 200 is connected to the reservoir 100 and provides a flow of brine from the reservoir 100 to the boom assembly 300, where the boom assembly 300 subsequently sprays the brine onto an exterior surface.

Figure 2:
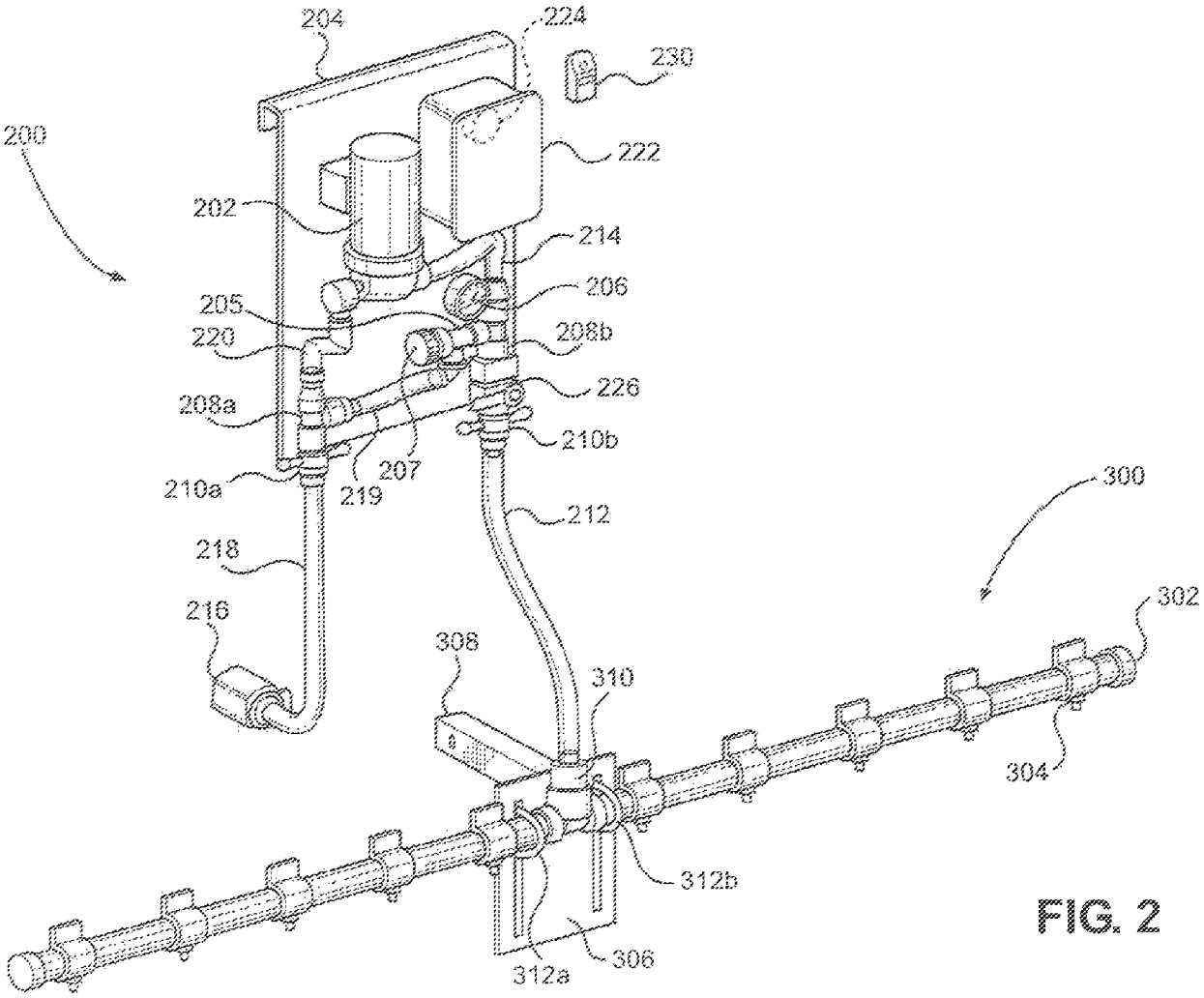
FIG. 2 is a front perspective view of the equipment panel having a pump and regulator in connection with an input from a reservoir tank and output to a boom assembly having multiple detachable spray nozzles with clip-on, non-threaded adapters and having a trailer hitch mount connected to the boom bracket.

Now referring to FIG. 2 in conjunction with FIG. 1, the preferred embodiment of the Large Area Liquid Solution Application 10 of the present invention includes a reservoir 100 connected to the equipment panel 200 and the boom assembly 300 connected to the equipment panel 200 forming a fluid flow path. Providing a consolidated equipment panel 200 organizes the internal working mechanics into a central, easy-access location. By grouping together all the necessary internal components onto a base 204, parts are not spread out and are easily accessible for maintenance. The base 204 is a plate made of steel and constructed to be removably attached to the reservoir 100. It is contemplated that the base 204 material may be made of any material which is strong, durable, and non-corrosive.

Equipment panel 200 includes a 12 V/8 GPM, corrosive resistant neoprene pump 202 with pressure shut-off such as a FloJet pump. While this type of pump is particularly well suited for the Large Area Liquid Solution Application 10 of the present invention, other pumps with varying specifications may be utilized and have been fully contemplated herein. Equipment panel also includes electrical box 222 housing a power component system 223 which provides the power required to run pump 202. The electrical box 222 has an electrical port 224 which allows connection to a power source, such as a battery. Wireless transmitter key 230 wirelessly communicates with the power component system 223 house within electrical box 222 and wirelessly activates the electrical equipment of the equipment panel 200.

The pump 202 generates hydraulic pressure and delivers a pressurized flow of fluid to the boom assembly 300. A multi-hose supply feed 216, multi-hose adapters 210(*a*) and 210(*b*), and reinforced hoses 212, 214, 218 and 220, form the fluid flow path allowing the liquid to flow from the reservoir 100 to the equipment panel 200 and through the boom assembly 300, respectively. This exposed design allows easy diagnostics of the equipment panel 200 without requiring laborious and difficult disassembly of any external housing to reach the working components of the present invention.

The liquid from the reservoir 100, via hose 218, flows into a feedback tee joint 208(*a*) and through hose 220 to the pump 202. The pump 202 pressurizes the fluid and delivers the fluid to hose 214 which is connected to feedback tee joint 208(*b*). Connected to feedback tee joint 208(*b*) at one tee joint is a poly ball valve 226 and connected to the other tee joint is a pressure regulator 205 with attached pressure meter 206. The poly ball valve 226 is connected to hose 212 which is connected to the boom assembly 300. The pressure regulator 205 is connected to a feedback control hose 219 which connects to feedback tee joint 208(*a*) to form a feedback loop which facilitates the regulation of pressure actuated by the pressure regulator 205.

In the preferred embodiment of the present invention, the pressure varies from 20 to 80 psi. The pump 202 includes a pressure switch which ensures a constant pressure in the pressurized side of the system. If the pump 202 reaches the pressure set point, the pump automatically shuts off. Alternatively, if the pressure falls below the pressure set point, the pump automatically turns on. It is also contemplated that a pump with a manual on-and-off switch may be used, which would allow a user to manually control the pump. If an urgent need arises to shut off the flow of fluid to the boom assembly 300, the poly ball valve 226 may be manually switched by the user to redirect all the fluid back through feedback control hose 219 into poly tee joint 208(*a*).

Pump 202 pressurizes and forces the liquid from the reservoir 100 through the boom assembly 300 by way of the feedback tee joint 208(*b*). The pressure meter 206 displays the current pressure within the hose 214, feedback tee joint 208(*b*), pressure regulator 205, poly ball valve 226, hose 212, and boom assembly 300. The delivery rate of the boom assembly 300 is dictated by the pressure within the system as measured by the pressure meter 206. Higher pressures will have a higher flow rate and lower pressures will have a lower flow rates. Using a pressure regulator knob 207 on the pressure regulator 205, the pressure in the system is finely tuned to adjust for the pressure required by the boom assembly 300 to deliver the amount of desired fluid. In circumstances where the pump 202 over pressurizes the system, the pressure regulator 205 will open and relieve pressure and flow fluid through the feedback hose 219. As shown, the feedback hose 219 relieves pressure and fluid back into tee joint 208(*a*). However, it is contemplated that the fluid may be introduced back into the system any point before the pump 202, such as directly back into the reservoir 100.

Figure 3:
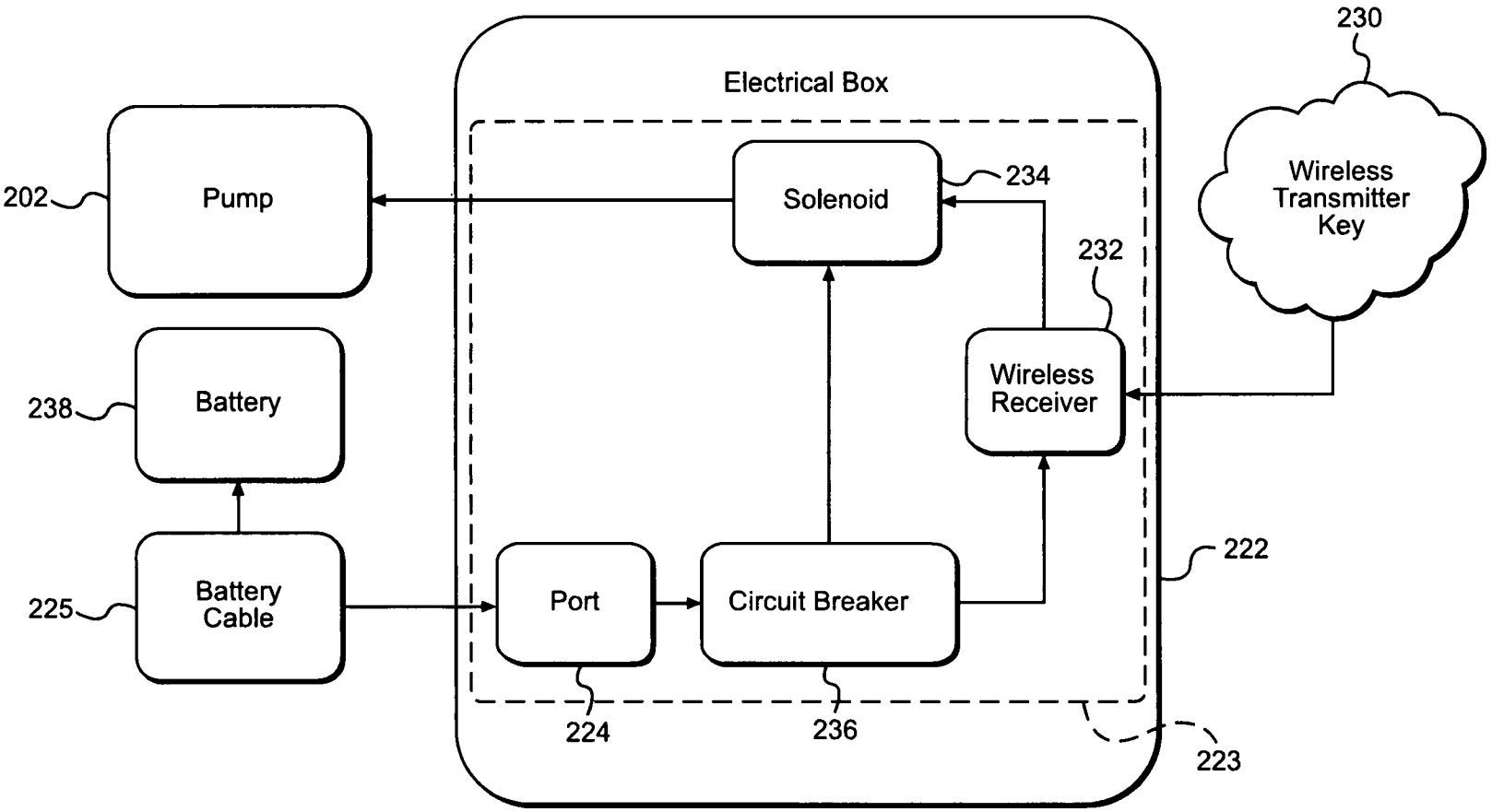
FIG. 3 is a block diagram of the present invention having a pump activated by a wireless transmitter key in wireless communication with the wireless receiver, the wireless receiver actuating a solenoid which links the battery to the pump to supply current.

Referring now to FIG. 3, a block diagram of the Large Area Liquid Solution Application 10 of the present invention having an electrical box 222 housing the power component system 223 is shown. The power component system 223 includes a low-current wireless receiver 232, a heavy duty 12V solenoid 234, a circuit breaker 236, and an electrical port 224. In an alternative embodiment, the electrical port 224 facilitates a power port to allow the connection of the power component system 223 to a variety of different power sources. A 50 Amp battery cable connector 225 creates a circuit between a battery 238, circuit breaker 236, and solenoid 234. The heavy duty 12 V solenoid 234 in conjunction with the circuit breaker 236 and battery 238 provide the necessary power to pump 202. Activating wireless transmitter key 230 transmits a wireless signal to wireless receiver 232, the wireless receiver 232 relays a small current to solenoid 234. The solenoid 234 then closes its internal circuit in response and completes the circuit between circuit breaker 236, battery 238, and pump 202.

To reduce the risk of voltage spikes and feedback issues arising from the use of power cables and varying deice impedances, a buffer circuit, circuit breaker 236, is utilized to ensure the risk of damage to property is averted. Utilizing a resettable circuit breaker ensures the pump 202 continually receives the required voltage and current while providing over current protection. Alternatively, a 40 Amp Maxi Fuse Holder and a 30 AMP Maxi Fuse may be used as circuit breaker 236 to ensure the pump 202 continually receives the required voltage, current, and over current protection as well. Using a solenoid combined with a transfer circuit buffer to convert a low signal input into high signal output is a common method of facilitating current modulation. While this particular configuration of facilitating current modulation and power supply is currently adopted, other configurations of power components, including various fuse limits and power cable tolerances, are well known to those with ordinary skill in the art and have been fully contemplated herein.

Figure 4:
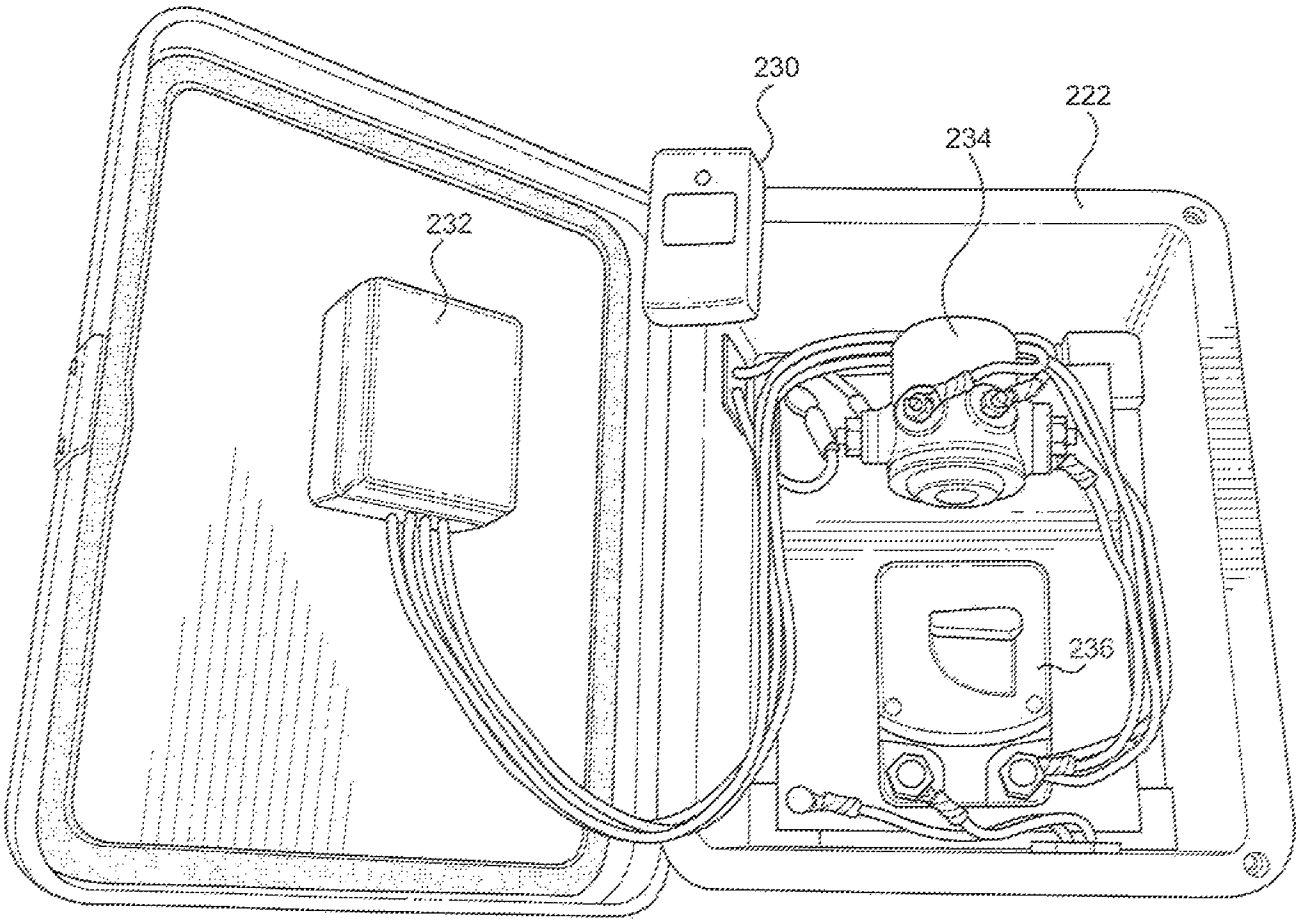
FIG. 4 is a top view of an electrical box of the equipment panel having a wireless receiver and a transmitter in communication with a solenoid and a circuit breaker.

Referring now to FIG. 4, the electrical box 222 is shown in further detail having solenoid 234 electrically linked to a circuit breaker 236. Circuit breaker 236 is a resettable circuit breaker having an amperage rating of 30 amps. It is contemplated that a 40 Amp Maxi Fuse Holder and a 30 AMP Maxi Fuse may be used in the alternative without departing from the scope and spirit of the invention. In order to safeguard against the inherent risks of operating electrical ports near liquids, the electrical box 222 is an industrial control panel enclosure such as the Stahlin J806HPL non-metal electrical enclosure. By utilizing hot compression molded fiberglass reinforced polyester and poured polyurethane seamless gaskets, electrical box 222 ensures outdoor elements such as rain and dust cannot corrode the electrical elements. Use of electrical box 222 will mitigate the risk of electrical shock to the user.

Further facilitating user friendliness, a wireless transmitter key 230 conveniently toggles the power to the pump 202. Wireless transmitter key 230 utilizes solid state transistors to transmit a wireless signal to communicate with the wireless receiver 232 which may be a commercially manufactured wireless transceiver system such as the Fimco 12-volt On/Off Remote Control. Having a range of 250 feet, the Fimco 12-volt On/Off remote control facilitates the user to toggle the Large Area Liquid Solution Application System 10 on or off without needing to dismount from the driver seat. Easily integrated into any system, the Fimco receiver 232 is prefabricated to connect into any Fimco product or may be wired into any 12 volt product with up to 20 Amperes. While the Large Area Liquid Application 10 of the present invention utilizes the Fimco wireless remote and receiver, other communication methods may be employed, are well known to those with ordinary skill, and can be used without departing form the scope and spirit of the present invention.

Now referring back to FIG. 2, hose 212 feeds the removable boom assembly, generally labeled 300. In the preferred embodiment, the removable boom assembly 300 includes a boom 302. In an embodiment, boom 302 is constructed to be 3/2"×7'; however, varying sizes of the boom 302 may be used without departing from the scope and spirit of the Large Area Liquid Solution Application 10 of the present invention.

A boom receiver 310 is fastened onto the boom 302 and feeds boom 302 liquid via hose 212. The boom 302 is attached to a boom bracket 306 via two adjustable fastening loops 312(*a*) and 312(*b*). The fastening loops 312(*a*) and 312(*b*) are able to slide vertically in the boom bracket 306 to facilitate height adjustment for boom 302 based on clearance needs. Boom bracket 306 is constructed with a hitch mount 308. Hitch mount 308 is constructed to adopt the standard pickup truck hitch receiver 22 shown in FIG. 1, and secures the boom assembly 300 to any standard pickup truck 20 having the standards pickup truck hitch receiver 22. It is contemplated that the hitch mount 308 may be adapted to correspond to any size pickup truck hitch receiver 22.

The Large Area Liquid Solution Application 10 of the present invention includes the ability to facilitate quick and easy cleaning during field use. Because liquid brine is susceptible to causing crystallization in applicator tips, decrystallizing the applicator becomes essential in maintaining efficient and even application. Ten snap-on nozzles 304 are spaced equidistantly across the length of the boom 302. When crystallization noticeably affects the liquid distribution pattern, removing and cleaning the nozzles 304 from boom 302 is easily managed by the snap on mechanical capability of the nozzles 304.

Nozzles 304 include commercially available nozzle tips, such as Spraying Systems Co.'s Quick TeeJet® nozzle, and are prefabricated without threaded fittings to facilitate easy installation into the boom 302. Not only does eliminating threading aid in maintenance, but also reduces the plumbing system complexity. By reducing the likelihood of crystallization in the nozzle tips, cleaning is required less frequently and overall reliability is increased. While the Quick TeeJet® removable nozzle is particularly well suited for the Large Area Liquid Solution Application 10 of the present invention, other removable nozzles may be used without departing from the spirit and scope of the present invention and have been contemplated herein.

Figure 5:
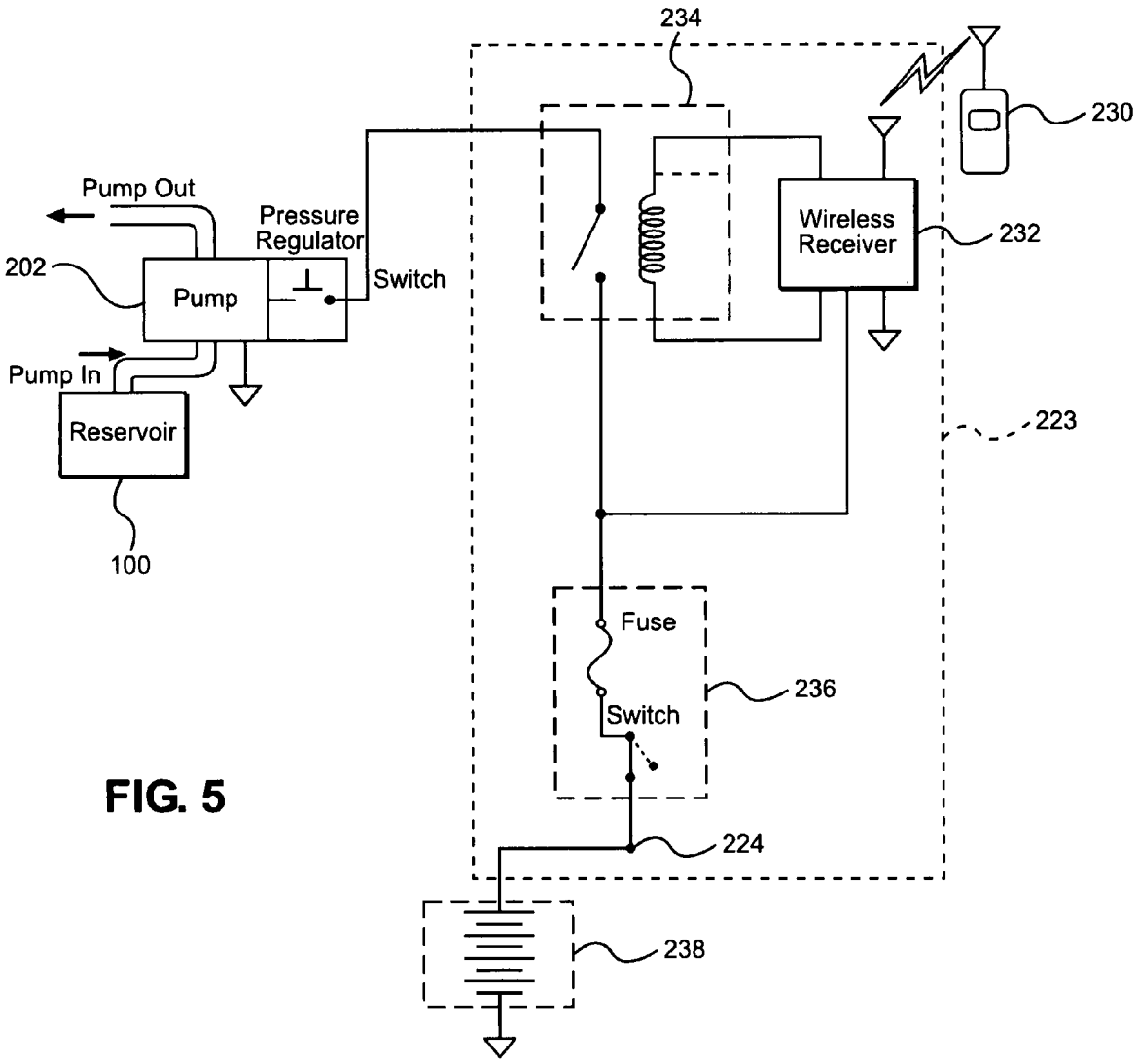
FIG. 5 is a circuit diagram of the present invention having a pump in communication with a solenoid having a normally-open circuit, the solenoid activated by a wireless receiver in wireless communication with a wireless transmitter key, and the solenoid closing the normally-open circuit which connects the battery to the pump when activated by the wireless transmitter.

Referring now to FIG. 5, a schematic diagram of the Large Area Liquid Solution Application 10 is shown. The battery 238 is connected to the circuit breaker 236 by way of electric port 224. As shown, the circuit breaker 236 is a resettable circuit breaker; however it is contemplated that a fuse and fuse holder may be used such as a 30 AMP Maxi Fuse and a 40 Amp Maxi Fuse Holder. The circuit breaker 236 connects to solenoid 234 having a low current switch and normally-open heavy duty contactors which closes when the low current switch is energized. Wireless receiver 232 is connected to the low current switch of the solenoid 234 and provides the low current required to switch the heavy duty contactors of the solenoid 234 closed when a signal from a corresponding wireless controller 230 is received.

When a signal is received from the wireless controller 230, the wireless receiver 232 provides current from the battery 238 to the low current coil to activate the solenoid 234. Once activated, the normally-open heavy duty contactor (switch) completes the circuit and provides electricity from the battery 238 to the pump 202. It is contemplated that an alternate electricity source may be used in place of the battery 238, through circuit breaker 236. For example, the electrical energy may come directly from the truck 20 by integrating the equipment panel 200 with the electrical system of the truck 20.

Figure 6:
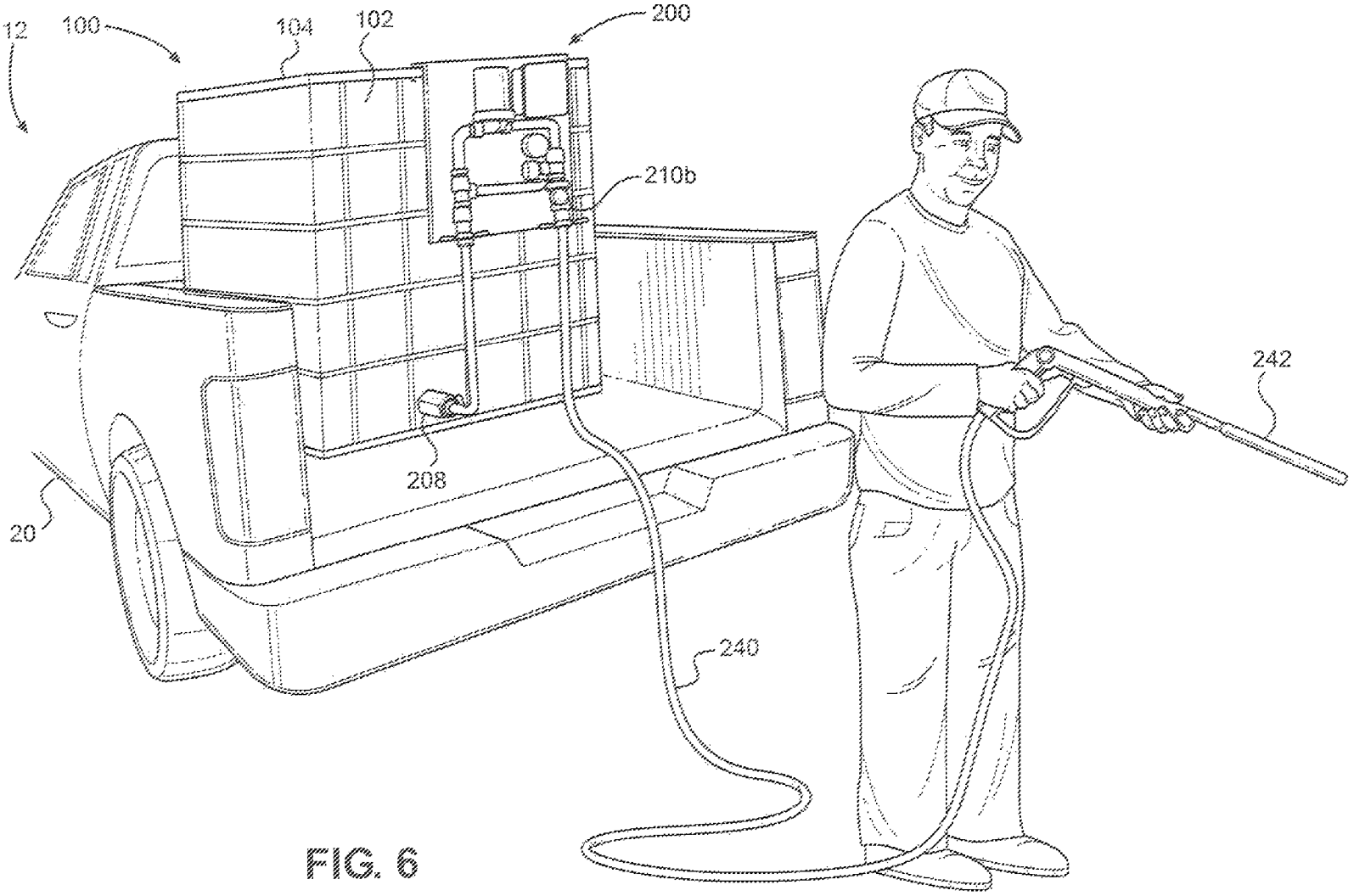
FIG. 6 is an alternative embodiment of the present invention having a handheld sprayer connected to the output of the equipment panel in place of the boom assembly having multiple detachable spray nozzles.

Referring now to FIG. 6, an alternative embodiment of the Large Area Liquid Solution Application 12 is shown. As shown, a handheld sprayer 242 is connected to a standard hose 240 directly connected to equipment panel 200, through the multi hose adapter 210(*b*). The boom assembly 300 has been completely disassembled and removed from the pickup truck 20. However, the boom assembly 300 may be kept attached to the pickup truck 20 for quick and easy transition from the handheld sprayer 242 to the boom assembly 300. Switching between the boom assembly and the handheld sprayer is accomplished quickly and easily by switching which spray apparatus is connected to the multi-hose adapter 210(*b*). The hose 240 of the handheld sprayer 242 may be replaced with the hose 212 of the boom assembly 200 and vice versa. The handheld sprayer is used to apply deicing solutions away from the vehicle, as a multi-season garden hose, or for any other uses.

While the particular Large Area Liquid Solution Application of the present invention as herein shown and disclosed in detail is fully capable of obtaining the objects and providing the advantages herein before stated, it is to be understood that it is merely illustrative of the presently preferred embodiments of the invention. No limitations are intended to the details of construction or design herein shown other than as described in the appended claims.

The invention claimed is:

1. A sprayer assembly comprising:

a reservoir containing a liquid, said reservoir sized to fit in a truck bed of a pickup truck;

an equipment panel comprising a base plate removably attached to said reservoir;

an electric pump attached to said equipment panel;

a power component system electrically connected to said pump, wherein said power component system is attached to said equipment panel;

a first hose between said reservoir and said pump;

a boom assembly having a plurality of detachable nozzles with clip-on, non-threaded adapters attached to said boom assembly;

a boom bracket formed with a hitch mount configured to be secured to a hitch receiver of a pickup truck, said boom assembly mounted to said boom bracket by a plurality of adjustable fastening loops, wherein said plurality of adjustable fastening loops are configured to slide vertically to facilitate height adjustment of said boom assembly;

a second hose between said pump and said boom assembly;

a feedback loop between said first hose and said second hose, said feedback loop comprises a tee joint between said first hose and said pump, a pressure regulator with an adjustment knob between said pump and said second hose, a feedback hose between said pressure regular and said tee joint, and wherein said pressure regulator relieves pressure between said pump and said boom assembly and flows fluid through said feedback hose and into said tee joint back into said pump; and wherein said pump draws said fluid from said reservoir and pumps said drawn fluid through said plurality of detachable nozzles.

2. The sprayer assembly of claim 1, wherein said reservoir further comprises a metal frame parametrically surrounding a tank of predetermined size and shape wherein said metal frame and said tank support the weight and storage of a predetermined capacity of liquid in said tank.

3. The sprayer assembly of claim 2, wherein said feedback loop further comprises a pressure gauge, said pressure gauge attached to said equipment panel.

4. The sprayer assembly of claim 3, wherein said equipment panel further comprises a poly ball valve connecting said pressure regulator to an outlet multi hose adapter.

5. The sprayer assembly of claim 4, wherein said said base plate is made of steel, wherein said electric pump, said power component system, said pressure regulator, said tee joint, said feedback hose, said pressure gauge, said poly ball valve, and said outlet multi hose adapter are mounted to consolidate the equipment into a central, easy-access location, said base plate providing a means to releasably secure said equipment panel onto said reservoir via mechanical function of said base plate.

6. The sprayer assembly of claim 5, wherein said power component system further comprises an electrical box housing an electrical port, a solenoid, a fuse, a wireless transmitter, wherein said electrical port, said fuse, said wireless transmitter, and said solenoid are electrically connected to a power source and to said pump.

7. The sprayer assembly of claim 6, wherein said boom assembly further comprises:

a boom, said plurality of detachable nozzles with clip-on, non-threaded adapters fluidly connected to said boom; and a boom receiver formed onto said boom including a hose having a first end connected to said boom receiver and a second end having an inlet multi hose adapter, wherein said inlet multi hose adapter is configured to fluidly connect to said outlet multi hose adapter of said equipment panel.

8. The sprayer assembly of claim 7, wherein said detachable nozzles can be manually removed from said boom via the mechanical function of said detachable nozzles.

9. The sprayer assembly of claim 7 further comprising a handheld sprayer, said handheld sprayer attached to a first end of a hose and an inlet multi hose adapter attached to a second end of said hose, said multi hose adapter is configured to attach to said outlet multi hose adapter of said equipment assembly, wherein said handheld sprayer may be attached to said equipment panel in place of said boom assembly.

10. The spray assembly system of claim 9, wherein said power source is a battery.

11. The spray assembly system of claim 9, wherein said power source is an electrical system of a pickup further comprises an electrical system, said electrical system is said power source of said equipment panel.

12. A method of equipping a truck having a truck bed and a hitch receiver to deice the roadway comprising the steps of:

providing a reservoir parametrically surrounded by a metal frame, said reservoir filled with a stored liquid;

attaching a removable equipment panel to said metal frame, said equipment panel comprising:

a base plate, an electric pump having an inlet and an outlet, a tee joint attached to said inlet of said electric pump, an inlet multi hose adapter attached to said tee joint, a pressure regulator with an adjustment knob attached to said outlet of said electric pump, an outlet multi hose adapter attached to said pressure regulator, a feedback hose between said pressure regular and said tee joint, wherein said pressure regulator relieves pressure between said pump and said boom assembly and flows fluid through said feedback hose and into said tee joint back into said pump, and a power component system electrically connected to said pump;

attaching a first hose between said reservoir and said inlet multi hose adapter of said equipment panel;

loading said reservoir with attached equipment panel on said truck bed;

providing a boom assembly having a plurality of detachable nozzles with clip-on, non-threaded adapters attached to said boom assembly;

providing a boom bracket formed with a hitch mount configured to be secured to said hitch receiver, said boom assembly mounted to said boom bracket by a plurality of adjustable fastening loops, wherein said plurality of adjustable fastening loops are configured to slide vertically to facilitate height adjustment of said boom assembly;

securing said boom bracket with mounted boom assembly to said hitch receiver;

attaching a second hose between said outlet multi hose adapter and said boom assembly; and applying stored liquid onto a roadway surface through said detachable nozzles with clip-on, non-threaded adapters while driving said truck on said roadway surface.

13. A sprayer assembly wherein said sprayer assembly is releasably loaded onto a conventional pickup truck having a truck bed and a hitch receiver, further comprising:

a reservoir for holding a liquid configured to be loaded onto a truck bed;

a removable handheld sprayer;

a boom assembly having a plurality of detachable nozzles with clip-on, non-threaded adapters attached to said boom assembly;

a boom bracket formed with a hitch mount configured to be secured to a hitch receiver, said boom assembly mounted to said boom bracket by a plurality of adjustable fastening loops, wherein said plurality of adjustable fastening loops are configured to slide vertically to facilitate height adjustment of said boom assembly;

an equipment panel removably attached to said reservoir, said equipment panel comprises:

a base plate, an electric pump having an inlet and an outlet, a tee joint attached to said inlet of said electric pump, an inlet multi hose adapter attached to said tee joint, a pressure regulator with an adjustment knob attached to said outlet of said electric pump, an outlet multi hose adapter attached to said pressure regulator, a feedback hose attached between said pressure regular and said tee joint, wherein said pressure regulator relieves pressure between said pump and said outlet multi hose adapter, and a power component system electrically connected to said pump;

a first hose connecting said reservoir to said inlet multi hose adapter; and a second hose connecting said outlet multi hose adapter to one of said handheld sprayer or said boom assembly.

14. The spray assembly system of claim 13, wherein said reservoir further comprises a metal frame parametrically surrounding a tank of predetermined size and shape wherein said metal frame and said tank support the weight and storage of a predetermined capacity of liquid in said tank.

15. The spray assembly system of claim 14, wherein said equipment panel, further comprises:

a pressure gauge.

16. The spray assembly system of claim 15, wherein said equipment panel further comprises a poly ball valve connecting said pressure regulator to said outlet multi hose adapter.

17. The spray assembly system of claim 16, wherein said handheld sprayer further comprises a handheld sprayer inlet multi hose adapter configured to mate with said outlet multi hose adapter, wherein said handheld sprayer can quickly and easily be detached from said outlet multi hose adapter and wherein said boom assembly further comprises a boom assembly inlet multi house adapter configured to mate with said outlet multi hose adapter, wherein said boom assembly can quickly and easily be detached from said outlet multi hose adapter.

18. The spray assembly system of claim 17, wherein said base plate is made from steel, wherein said electric pump, said power component system, said pressure regulator, said tee joint, said feedback hose, said pressure gauge, said poly ball valve, and said outlet multi hose adapter are mounted on said base plate to consolidate the equipment into a central, easy-access location.

19. The spray assembly system of claim 18 wherein said power component system further comprise an electrical box housing an electrical port, a solenoid, a fuse, and a wireless transmitter, wherein said electrical port, said fuse, said wireless transmitter, and said solenoid are electrically connected with a power source.

* * * * *